US006108432A

United States Patent [19]

Watanabe

[11] Patent Number: 6,108,432

[45] Date of Patent: Aug. 22, 2000

[54] SURFACE MOUNT ELECTROMAGNETIC SOUND PRODUCING DEVICE

[75] Inventor: Shigehisa Watanabe, Yamanashi-ken, Japan

[73] Assignee: Citizen Electronics Co., Ltd., Fujiyoshida, Japan

[21] Appl. No.: 08/936,725

[22] Filed: Sep. 25, 1997

[30] Foreign Application Priority Data

Dec. 26, 1996 [JP] Japan ..... 8-356436

[51] Int. Cl.[7] ..... H04R 25/00

[52] U.S. Cl. ..... 381/395; 381/417; 381/398; 381/355

[58] Field of Search ..... 381/345, 162, 381/361, 177, 386, 395, 191, 429, 417, 398, 355

[56] References Cited

U.S. PATENT DOCUMENTS

| | | | |
|---|---|---|---|
| 2,293,078 | 12/1942 | Proctor | 381/177 |
| 3,560,667 | 2/1971 | Carlson | 179/114 |
| 3,742,156 | 6/1973 | Broersma | 179/119 A |
| 3,935,398 | 1/1976 | Carlson et al. | 179/114 A |
| 4,009,355 | 2/1977 | Poradowski | 179/121 D |
| 4,308,431 | 12/1981 | Hanbicki | 179/111 R |
| 4,504,703 | 3/1985 | Schneiter et al. | 179/102 |
| 4,578,808 | 3/1986 | West | 381/88 |
| 4,843,628 | 6/1989 | Hofer | 381/200 |
| 5,085,628 | 2/1992 | Engebretson | 600/25 |

*Primary Examiner*—Curtis A. Kuntz
*Assistant Examiner*—Dionne Harvey
*Attorney, Agent, or Firm*—Dennison, Scheiner, Schultz & Wakeman

[57] ABSTRACT

A casing is provided to be mounted on a printed circuit. The casing has a lower casing and an upper casing. An actuator is provided in the casing, and an armature is supported in the casing so as to be vibrated by the actuator. A sound emanating hole is formed in a peripheral side wall of the upper casing, and a pressure releasing hole is formed in a peripheral side wall of the lower casing.

7 Claims, 4 Drawing Sheets

SURFACE MOUNT ELECTROMAGNETIC SOUND PRODUCING DEVICE

BACKGROUND OF THE INVENTION

The present invention relates to an electromagnetic sound producing device which is mounted on a printed circuit of an electronic equipment by the surface-mount technology.

In recent years, various electronic equipments have become smaller in size and lighter in weight. Not only operational elements, memories and connectors, but other electronic devices have come to be directly mounted on a printed circuit as well. An electromagnetic sound producing device which is one type of a compact buzzer, is now generally directly mounted on the surface of the printed circuit by the surface-mount technology. Moreover, in order to realize a printed circuit of high-density and multilayer, it is necessary that the mounting position of the device can be arbitrarily selected.

On the other hand, the sound producing device has a sound emanating hole which is formed in a wall of a casing opposite an armature thereof. In order to generate a large sound even at a low frequency, it is necessary to form a release opening in the opposite wall of the casing at the other side of the armature so that back pressure caused by the vibration of the armature is released. Due to the restrictions imposed on the structure of a die for manufacturing the casing, the release opening is formed in a base which forms a bottom of the casing of the sound producing device, attached to the printed circuit board.

More particularly, in the die comprising a lower die and upper die, the upper die is upwardly moved when taking out a moulding. In order to form the opposite release opening, a core pin must be inserted in the moulding material. However, in order to form the opening in the vertical side wall, the core pin must be inserted in the horizontal direction. To raise the upper die, the core pin must be retracted before the raising. Such a die causes the construction thereof to be very complicated. Therefore, there has not been provided such a complicated die.

FIGS. 5 and 6 show a conventional surface-mount sound producing device manufactured by a conventional die. The surface-mount sound reproducing device is mounted on a printed circuit 50. The sound producing device comprises a plastic lower casing 51 directly mounted on the upper surface of the printed circuit 50 and an upper plastic casing 52 mounted on the lower casing 51. The lower casing 51 comprises a substantially square base 51*a* and four peripheral walls 51*c* attached to the base 51*a*. The four corners of the peripheral wall 51*c* are chamfered, as shown in FIG. 6.

Referring to FIG. 6, securely mounted on the underside of the base 51*a* are externally connecting terminals 53 and 54, each having a square shape, embedded therein at two adjacent corners thereof, and metal plates 55 and 56 embedded at other corners. The externally connecting terminals 53 and 54 are provided to connect a coil of the sound producing device with a circuit formed on the printed circuit 50, and plates 55 and 56 are provided for ensuring the adhesion of the device to the printed circuit. When mounting the sound producing device on the printed circuit 50, the two externally connecting terminals 53 and 54 are adhered to, and hence electrically connected with the terminals of the printed circuit 50 by means such as soldering. The plates 55 and 56 are likewisely adhered to the printed circuit 50.

In order to accurately position the upper casing 52 on the lower casing 51, there are provided four guide blocks 68 projecting vertically upward from the lower casing 51 at the four corners as shown in FIGS. 7 and 8. The guide block 68 is disposed inside the outer peripheral wall 51*c* so as to form a guide face 68*a* for the upper casing 52.

Referring back to FIG. 5, in the lower casing 51, there is securely mounted a magnetic yoke 57 having a center pole 58. A cylindrical armature supporting member 60 made of brass is securely mounted on the yoke 57 with adhesive. A coil 66 is mounted on the yoke 57, coaxial with the center pole 58. By mounting the coil, both ends of the coil are electrically connected to the respective externally connecting terminals 53 and 54 through inside terminals 76 and 77 (FIG. 7) in the base 51*a* of the lower casing 51. A cylindrical permanent magnet 65 which is vertically magnetized is disposed on the yoke 57 so as to surround the coil 66.

An armature 61 having a magnetic pole piece 62 secured on the surface at the center thereof is mounted on the upper edge of the supporting member 60, and attracted by magnetic force described hereinafter, thereby defining a lower chamber 63 and an upper chamber 64 in the space inside the lower and upper casings 51 and 52. The yoke 57, coil 66 and the permanent magnet 65 compose an actuator for driving the armature 61. The armature 61 is normally attracted to the supporting member 60 by the magnetomotive force of the permanent magnet 65, and held by an inside wall of an upward projection 68*b* (FIG. 8) of the guide block 68.

The upper casing 52 has a shape similar to that of the lower casing 51 and has four peripheral side walls 52*a* and a square cover plate 52*b*. The four corners of the upper casing 52 are chamfered to conform to the periphery of the lower casing 51. A plurality of armature stoppers 67 are formed on the underside of the cover plate 52*b*, forming a small gap between the lower surfaces of stoppers 67 and the armature 61.

The upper casing 52 is mounted on the lower casing 51 so that the guide face 68*a* of the guide block 68 snugly fits therein. The lower and upper casings 51 and 52 are further adhered to each other by ultrasonic welding.

The sound producing device is further provided with a sound emanating hole 70 formed in the cover plate 52*b* of the upper casing 52 at the center thereof. A plurality of sound passages 71 are formed in a housing 72 confronting the sound emanating hole 70. The base 51*a* and the yoke 57 have openings 73 and 74, respectively, each coinciding with each other. A release hole 75 is further formed in the printed circuit 50 confronting the opening 74 of the casing 51, thereby communicating the lower chamber 63 with the ambience.

In operation, a sound producing device driving signal produced in an electronic circuit (not shown) formed on the printed circuit 50, is applied to the coil 66 of the actuator of the sound producing device through the terminal of the circuit, the externally connecting terminals 53 and 54, and the inside terminals 76 and 77. The coil 66 is hence excited, and in cooperation with the permanent magnet 65, vibrates the armature 61, thereby generating a sound. The sound is emanated out of the housing 72 through the upper chamber 64, sound emanating hole 70 and the sound passages 71. The back pressure which is caused by vibration of the armature 61 is released through an air passage comprising the lower chamber 63, openings 73 and 74 and the release hole 75. Without such an air passage, the back pressure cannot be released, thereby restraining the vibration of the armature 61. As a result, the volume of the generated sound becomes smaller, particularly in a low frequency range. Thus the air passage is indispensable.

In the above described conventional sound producing device, because of the structure of the die for moulding the plastic casing, the opening 74 must be formed in the base 51*a* of the lower casing 51. Accordingly, it becomes necessary to perforate the release hole 75 in the printed circuit 50 at the position corresponding to the opening 74. This restricts the choice in designing the printed circuit, and hence, becomes an obstacle in producing a high-density printed circuit which is multiple layered, compact, light in weight, and also inexpensive. However, the problem of the die belongs to a technical field other than the electromagnetic sound producing device. Therefore, it will be better to consider the problem of the die, separating from the sound producing device itself.

On the other hand, if the sound emanating hole 70 is formed in the cover plate 52*b* as in the conventional device of FIG. 5, the sound passages 71 must be formed to directly confront the hole 70 in order that the sound is satisfactorily emanated, However such an inevitable condition restricts the design choice of the housing 72.

SUMMARY OF THE INVENTION

An object of the present invention is to provide a surface mount electromagnetic sound producing device packaged on a printed circuit wherein the position for mounting the sound producing device on the printed circuit and other designs of the circuit can be arbitrarily determined without decreasing the volume of the generated sound in a low frequency range. Hence the design of the housing of the electronic equipment incorporating the sound producing device can also be arbitrarily determined, and the size and the cost of the equipment is reduced.

According to the present invention, there is provided a surface mount electromagnetic sound producing device comprising a casing to be mounted on a printed circuit, an actuator provided in the casing, an armature supported in the casing so as to be vibrated by the actuator, external terminals provided on an underside of the casing so as to be connected to a circuit on the printed circuit, a wall of the casing having a sound releasing hole, and a peripheral side wall of the casing having a pressure releasing hole.

The casing has a lower casing and an upper casing, the sound emanating hole is formed in a wall of the upper casing, and the pressure releasing hole is formed in a peripheral side wall of the lower casing.

The sound emanating hole is formed in a peripheral side wall of the casing.

The sound emanating hole is formed in a peripheral side different from the peripheral side wall in which the pressure release hole is formed.

The pressure releasing hole is formed in a peripheral side wall which is opposite to the peripheral side wall in which the sound emanating hole is formed.

These and other objects and features of the present invention will become more apparent from the following detailed description with reference to the accompanying drawings.

DETAILED DESCRIPTION OF THE PREFERRED EMBODIMENT

Figure 1:
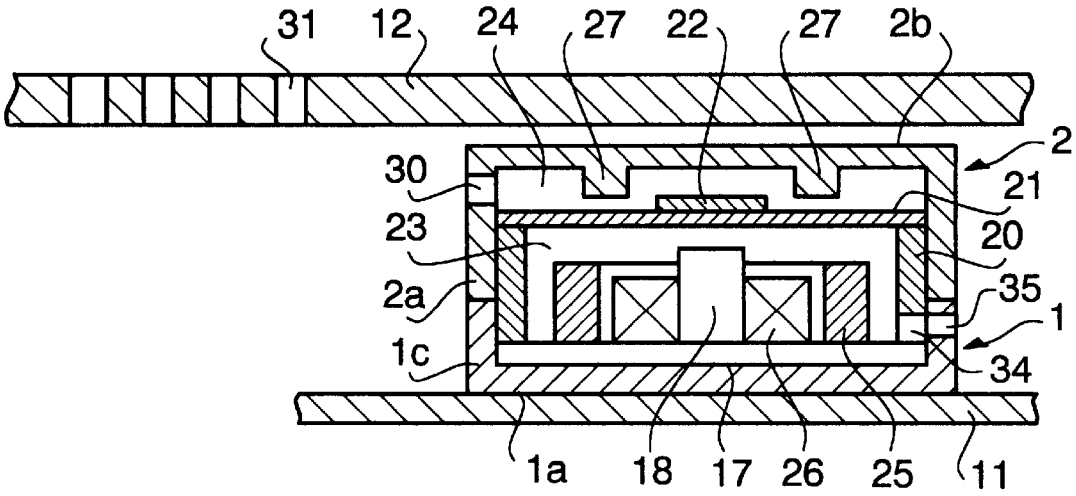
FIG. 1 is a sectional view of an electronic equipment having an electromagnetic sound producing device according to the present invention.
Figure 5:
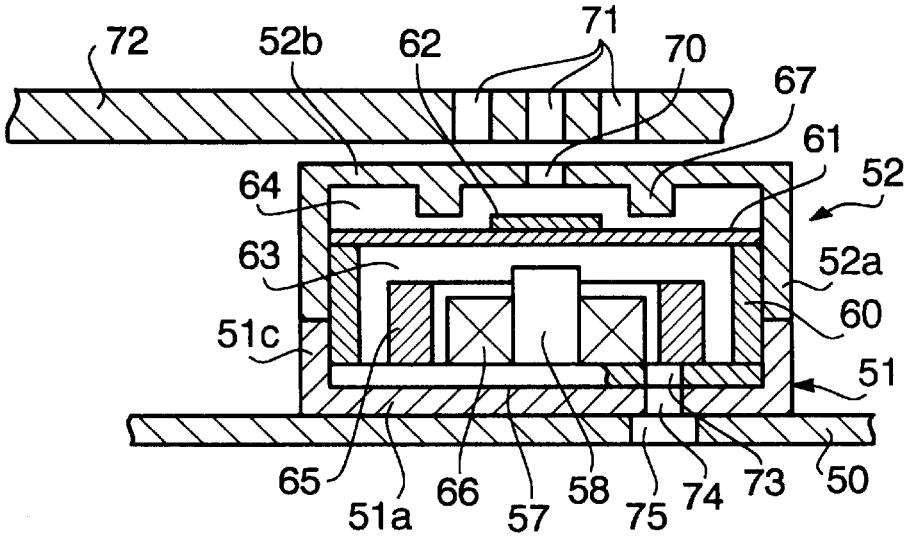
FIG. 5 PRIOR ART
FIG. 5 is a sectional view of an electronic equipment having a conventional electromagnetic sound producing device.
Figure 6:
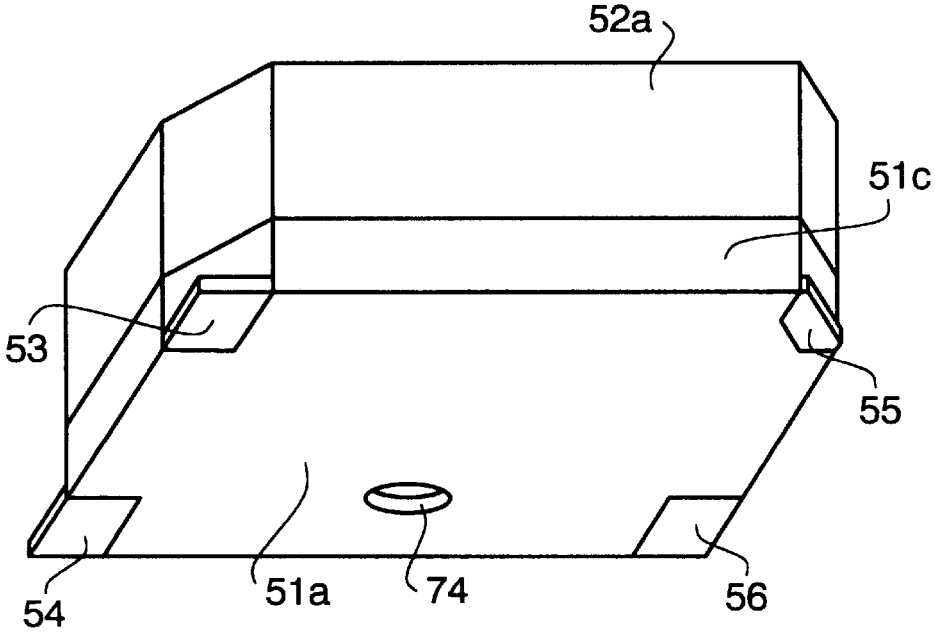
FIG. 6 PRIOR ART
FIG. 6 is a perspective view of the sound producing device as seen from the underside, showing the left side thereof in FIG. 5.

Referring to FIG. 1, an electromagnetic sound producing device according to the present invention mounted on a printed circuit 11 and contained in a housing 12 has a similar construction as the conventional sound producing device shown in FIGS. 5 and 6.

The surface-mount sound reproducing device is mounted on a printed circuit 11. The sound producing device comprises a plastic lower casing 1 directly mounted on the upper surface of the printed circuit 11 and an upper plastic casing 2 fixed to the lower casing 1. The lower casing 1 comprises a substantially square base 1*a* and four peripheral side walls 1*c* attached to the base 1*a*. The four corners of the peripheral wall 1*c* are chamfered, as shown in FIG. 2.

Figure 2:
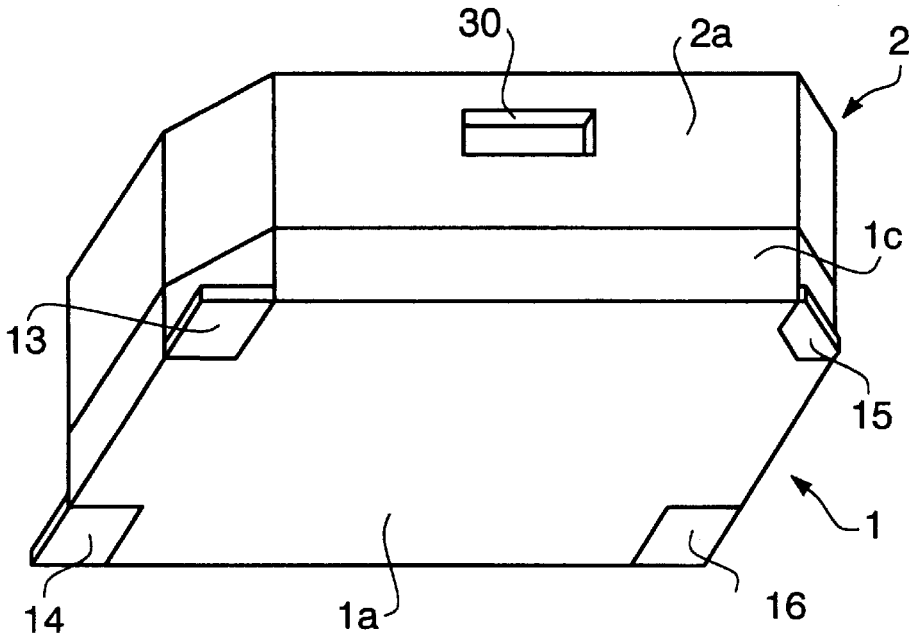
FIG. 2 is a perspective view of the sound producing device as seen from the underside, showing the left side thereof in FIG. 1.

Referring to FIG. 2, externally connecting terminals 13 and 14, each having a square shape, are embedded in the underside of the base 1*a*, and metal plates 15 and 16 are embedded in other corners. The externally connecting terminals 13 and 14 are provided to connect a coil of the sound producing device with a circuit formed on the printed circuit 11, and plates 15 and 16 are provided for ensuring the adhesion of the device to the printed circuit. When mounting the sound producing device on the printed circuit 11, the two externally connecting terminals 13 and 14 are adhered to, and hence electrically connected with the terminals of the printed circuit 11 by means such as soldering. The plates 15 and 16 are likewisely adhered to the printed circuit 11.

Figure 8:
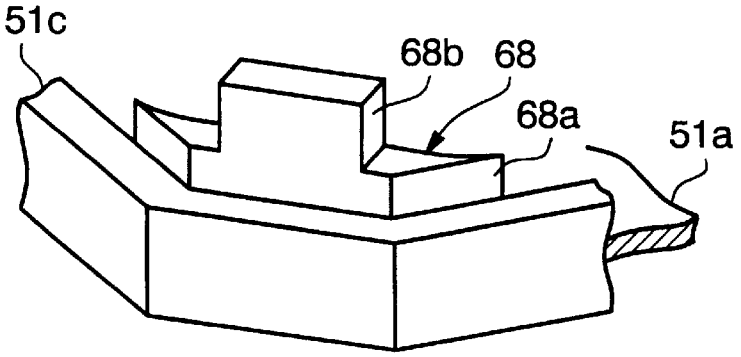
FIG. 8 PRIOR ART
FIG. 8 is a perspective view showing a part of the lower casing.

In order to accurately position the upper casing 2 on the lower casing 1, there are provided four guide blocks (not shown), each of which is the same as the guide block 68 of FIG. 8.

Referring to FIG. 1, in the lower casing 1, there is securely mounted a magnetic yoke 17 having a center pole 18. A cylindrical armature supporting cylinder 20 made of brass is securely mounted on the yoke 17 with adhesive. A coil 26 is mounted on the yoke 17, coaxial with the center pole 18. By mounting the coil, both ends of the coil are electrically connected to the respective externally connecting terminals 13 and 14 through inside terminals (76 and 77 of FIG. 7). A cylindrical permanent magnet 25 which is vertically magnetized is disposed on the yoke 17 so as to surround the coil 26.

An armature 21 having a magnetic pole piece 22 secured on the surface at the center thereof is mounted on the upper edge of the supporting cylinder 20, and attracted by magnetic force, thereby defining a lower chamber 23 and an upper chamber 24 in the space inside the lower and upper casings 1 and 2. The yoke 1, coil 2 and the permanent magnet 25 compose an actuator for driving the armature 21. The armature 21 is normally attracted to the supporting member 20 by the magnetomotive force of the permanent magnet 25, and held by an inside wall of an upward projection of the guide block (68 of FIG. 8).

The upper casing 2 has a shape similar to that of the lower casing 1 and has four peripheral side walls 2*a* and a square cover plate 2*b*. The four corners of the upper casing 2 are chamfered to conform to the periphery of the lower casing 1. A plurality of armature stoppers 27 are formed on the underside of the cover plate 2*b*, forming a small gap between the lower surfaces of stoppers 27 and the armature 21.

The upper casing 2 is mounted on the lower casing 1 so that the guide face of the guide block (FIG. 8) snugly fits therein. The lower and upper casings 1 and 2 are further adhered to each other by ultrasonic welding.

Figure 3:
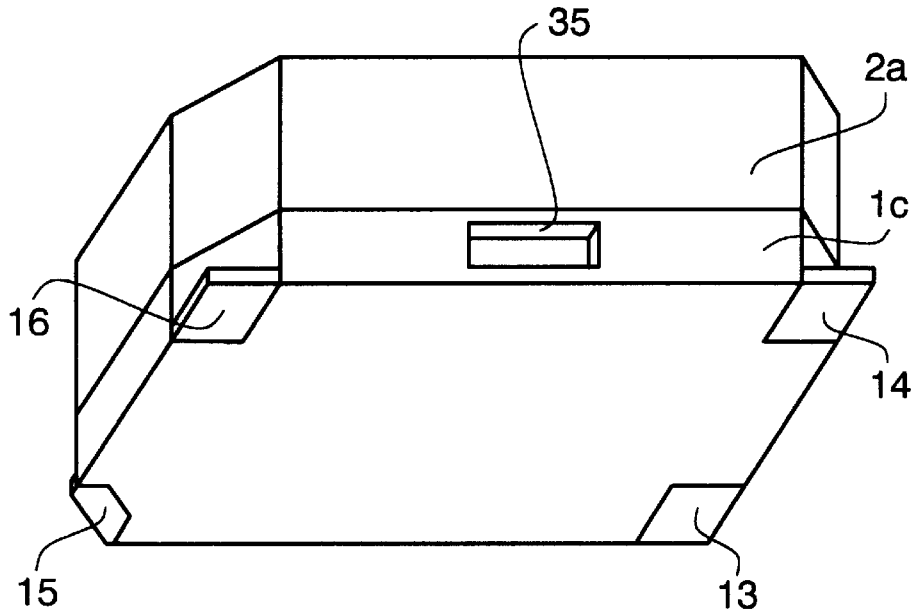
FIG. 3 is a perspective view of the sound producing device as seen from the underside, showing the right side thereof in FIG. 1.

In accordance with the present invention, the sound producing device is provided with a sound emanating hole 30 formed in one of the peripheral side walls 2*a* of the upper casing 2. As shown in FIG. 2, the sound emanating hole 30 has a horizontally elongated rectangular shape, disposed parallelly to the cover plate 2*b*. On the other hand, a pressure release hole 35 is formed in one of the side walls 1*c* of the lower casing 1 which is opposite to the sound emanating hole 30. An opening 34 is formed in the armature supporting cylinder 20, corresponding to the release hole 35, thereby communicating the lower chamber 23 with the ambience. The release hole 35 has a horizontally elongated rectangular shape similar to the sound emanating hole 30 as shown in FIG. 3. A plurality of sound passages 31 are formed in the housing 12 at proper positions for discharging the sound from the sound emanating hole 30.

In a modification of the casing for the sound producing device, a flat base may be provided instead of the lower casing 1. The height of the side wall 2*a* of the upper casing 2 is accordingly increased.

The sound producing device of the present invention is mounted on the printed circuit 11 in the same manner as the conventional device. However, it is not necessary to form the release hole (75 of FIG. 5) in the printed circuit.

Figure 7:
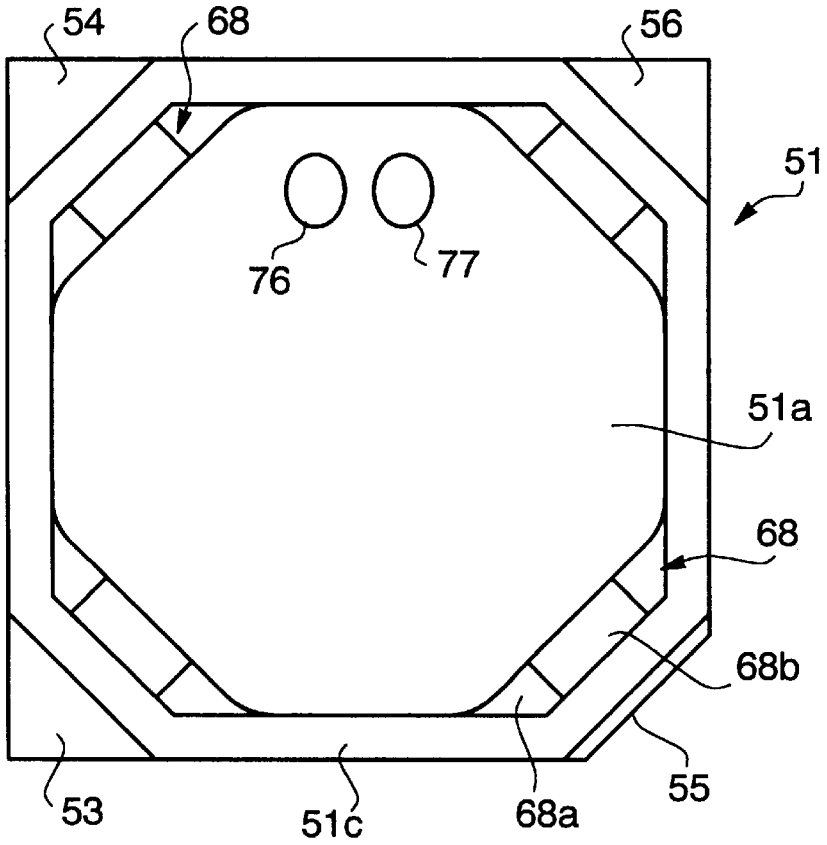
FIG. 7 PRIOR ART
FIG. 7 is a plan view of a lower casing.

In operation, a sound producing device driving signal produced in an electronic circuit (not shown) formed on the printed circuit 50, is applied to the coil 26 of the actuator of the sound producing device through the terminals of the circuit, the externally connecting terminals 13 and 14, and the inside terminals (76 and 77 of FIG. 7). The coil 26 is hence excited, and in cooperation with the permanent magnet 25, vibrates the armature 21, thereby generating a sound. The sound is emanated out of the housing 12 through the upper chamber 24, sound emanating hole 30 and the sound passages 31.

The back pressure in the lower chamber 23 is released through the opening 34 formed in the supporting cylinder 20 and the release hole 35 formed in the lower casing 1. Hence a large sound in the low frequency range can be generated as in the conventional sound producing device having a release opening in the printed circuit 11.

In the sound producing device of the present invention, since the release hole 35 for releasing the back pressure is formed in the peripheral side wall 1*c* of the lower casing 1 and not in the base 1*a*, it is not necessary to perforate a release hole in the printed circuit 11. Thus the position where the sound producing device is to be mounted is not restricted, thereby allowing a larger freedom in designing the printed circuit 11. As a result, it is possible to reduce the size and the cost of the electronic equipment wherein the electromagnetic sound producing device is packaged.

In addition, since the sound emanating hole 30 is formed in the upper peripheral side wall 2*a* of the upper casing 2, the sound passages 31 need not directly confront the hole 30. It suffices to form the sound emanating hole 30 in the direction of the sound passages 31, provided the distance between the hole 30 and the passages 31 is not too long. Hence the position for mounting the sound producing device on the printed circuit 11 may be further arbitrarily determined.

Moreover, the opening 35 is positioned at the rear of the sound emanating hole 30 so that the sound emitted is not attenuated by the interference of the noise generated from the opening 35. The position of the opening 35 need not be limited to the rear of the emanating hole 30 as long as the opening 35 and hole 30 are not in the same plane, and far apart from each other as much as possible.

Although the pressure release hole has a rectangular shape in the above described embodiment, a pressure release hole having a round shape may be used.

Figure 4:
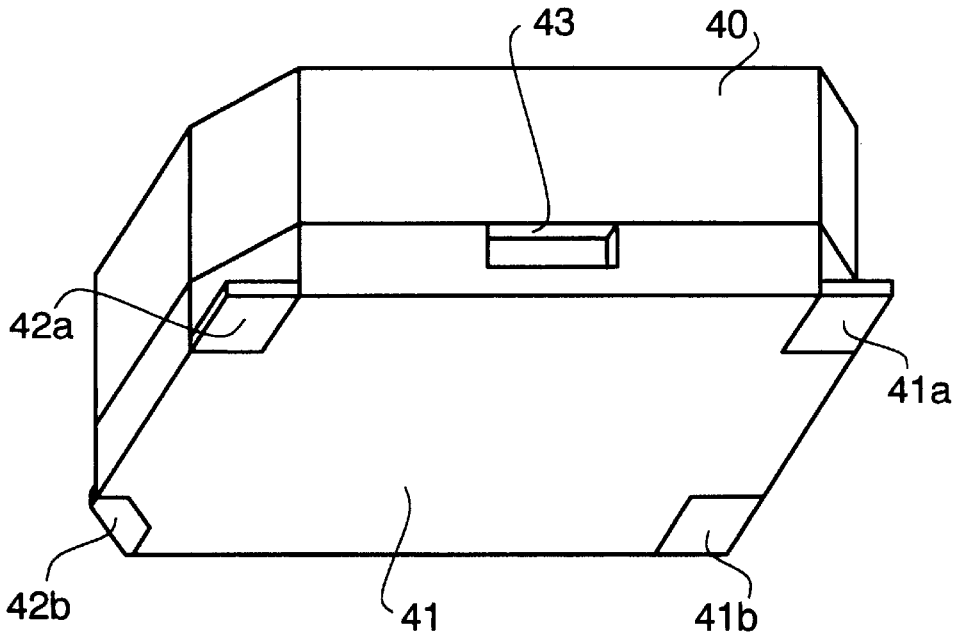
FIG. 4 is a perspective view of a second embodiment of the sound producing device as seen from the underside.

FIG. 4 shows the second embodiment of the present invention wherein the lower casing is easily formed. The sound producing device has an upper casing 40 which is identical with the upper casing 2 of the first embodiment. A plastic lower casing 41 is formed into a shape of a cup and has externally connecting terminals 41*a* and 41*b* and adhesive terminals 42*a* and 42*b* on the bottom thereof. A part of the upper edge of one wall of the lower casing 41 is cut away to form a recess 43 instead of the opening 35 shown in FIG. 3. Namely, the plastic lower casing 41 can be easily formed by injection mould without employing a complicated horizontally sliding mould which increases the manufacturing cost of the casing. The lower casing 41 may further be made of metal, in which case the casing 41 is shaped by bending. Hence the distortion of the casing, which occurs in a plastic casing when a narrow portion thereof is pulled, can be prevented.

In accordance with the present invention, the sound producing device has an opening for releasing the back pressure in a wall of a casing other than the wall which contacts the printed circuit. Hence it is possible to arbitrarily design the patterns of the circuit and determine the position for mounting the sound producing device on the printed circuit, thereby enabling to manufacture a high-density and multiple-layered packaged devices. The electronic equipment incorporating the sound producing device of the present invention is hence inexpensive, compact and furthermore, small in thickness.

Since the opening for releasing the back pressure is horizontally elongated, the thickness of the sound producing device can be reduced without decreasing the area thereof.

In the sound producing device of the present invention, the sound emanating hole is formed in the side wall of the casing. Hence the relative position of the sound emanating hole to the sound passages of the housing for an electronic equipment incorporating the sound producing device is less restrictive than when the sound emanating hole is formed on the upper surface of the device.

The opening for releasing the back pressure is formed at a distance from the sound emanating hole so that the sound which is emanating from the hole is not attenuated by the interference of the noise from the opening.

In the case where the release opening is a recess, the casing can be easily manufactured without complicating the die, thereby decreasing the manufacturing cost.

While the invention has been described in conjunction with preferred specific embodiment thereof, it will be understood that this description is intended to illustrate and not limit the scope of the invention, which is defined by the following claims.

What is claimed is:

1. A surface mount electromagnetic sound producing device comprising:

a casing having a base to be mounted on a printed circuit, a side wall perpendicular to the printed circuit when the base is mounted on the printed circuit, and a cover plate on the peripheral side wall;

an actuator provided in the casing;

an armature supported in the casing so as to be vibrated by the actuator; and, external terminals provided on an underside of the casing so as to be connected to a circuit on the printed circuit, wherein, the peripheral side wall of the casing includes a sound emanating hole communicating with an upper chamber on the upper side of the armature; and, the peripheral side wall includes a pressure releasing hole communicating with a lower chamber partially defined by the lower side of the armature.

2. The device according to claim 1 wherein the casing has a lower casing and an upper casing, the sound emanating hole is formed in a wall of the upper casing, and the pressure releasing hole is formed in a peripheral side wall of the lower casing.

3. The device according to claim 2 wherein the actuator comprises a magnetic yoke provided on a base of the lower casing, a permanent magnet and a coil mounted on the yoke, respectively.

4. The device according to claim 1 wherein the pressure releasing hole has a rectangular shape in the surface of the peripheral side wall.

5. The device according to claim 4 wherein the longer side of the rectangular shape is parallel with a base of the casing.

6. The device according to claim 5 wherein the pressure releasing hole is formed by a recess without an upper longer side.

7. A surface mount electromagnetic sound producing device comprising:

a casing having a base to be mounted on a printed circuit, a side wall perpendicular to the printed circuit when the base is mounted on the printed circuit, and a cover plate on the peripheral side wall;

an actuator provided in the casing;

an armature supported in the casing by an armature support so as to be vibrated by the actuator; and, external terminals provided on an underside of the casing so as to be connected to a circuit on the printed circuit, wherein, the peripheral side wall of the casing includes a sound emanating hole communicating with an upper chamber on the upper side of the armature; and, the armature support includes a pressure releasing hole aligned with a pressure releasing hole in the peripheral side wall allowing communication between a lower chamber on the lower side of the armature and the exterior of the device.

* * * * *